United States Patent [19]

Marbourg, Jr.

[11] Patent Number: 4,722,714

[45] Date of Patent: Feb. 2, 1988

[54] COIN PACKAGING DEVICE

[76] Inventor: Edgar F. Marbourg, Jr., 437 Hillcrest Rd., San Carlos, Calif. 94070

[21] Appl. No.: 892,328

[22] Filed: Aug. 4, 1986

[51] Int. Cl.[4] ..... G07D 9/06

[52] U.S. Cl. ..... 453/59; 53/254; 453/62

[58] Field of Search ..... 133/1 R, 1 A, 8 R, 8 A; 53/212, 213, 254; 453/59, 62

[56] References Cited

U.S. PATENT DOCUMENTS

| | | | |
|---|---|---|---|
| 961,832 | 6/1910 | Ayres | 133/1 A X |
| 1,274,615 | 8/1918 | Sherwood | 133/1 A X |
| 3,967,435 | 7/1976 | Bergmaier | 53/254 |
| 4,036,358 | 7/1977 | Kelley | 133/1 A X |
| 4,091,599 | 5/1978 | Lemieux | 133/1 A X |
| 4,153,197 | 5/1979 | Hall | 232/5 |
| 4,244,157 | 1/1981 | Vondra et al. | 133/1 A X |
| 4,407,313 | 10/1983 | Ventura | 133/8 A |
| 4,407,314 | 10/1983 | Ventura | 133/8 A |

*Primary Examiner*—F. J. Bartuska
*Attorney, Agent, or Firm*—Marshall C. Gregory

[57] ABSTRACT

A coin counting and packaging device in which a coin counting tube is precisely dimensioned so that a specified standard paper coin wrapper will just fit inside and accept the proper number of coins to fill the wrapper, the coins being fed through a loading cap which acts to sweep away any extra coins over and above the proper number, thus determining the correct count. While the coins are being loaded and counted they rest on a support pedestal projecting up into the coin tube from a base; when the tube is full, and raised off the base, the coins rest on a rim at the bottom of the tube. The coin tube has on its bottom edge a cam surface which cooperates with a mating cam on the support base, to raise the coin tube a distance such that the upper end of the paper wrapper may be pinched shut at the top of the tube, preparatory to removing the coin-filled wrapper.

6 Claims, 7 Drawing Figures

COIN PACKAGING DEVICE

BACKGROUND OF THE INVENTION

The invention is a device intended primarily for sorting, counting and easily wrapping coins in standard paper wrappers for the four most common denominations of United States coins. Coins in wrappers are widely used in banks and business establishments for storage, transport and quick counting and resupply for cash registers and similar uses. As the device must be of the proper size for the selected coin, there is contemplated one separate device for each of the four denominations. The device herein described could, of course, be adapted by a change of dimensions for wrapping coins of other countries, as well as medallions or commemorative coins or similar items.

The invention not only provides a means to quickly package coins in commercially available paper wrappers, but eliminates the need for separate counting, as the device itself meters or measures the exact number of coins necessary to fill the paper wrappers. In the denominations of United States coinage, these paper wrappers contain 50 pennies, 40 nickels, 50 dimes or 40 quarters.

The need for such a device has long been perceived and there have been numerous proposed designs, a number of which have resulted in issue of United States patents, dating back to as early as 1917. Applicant specifically cites the following, which will be referred to by the letter shown.

These patents all share a common element in that at least one cylindrical tube is provided as the basic means for accumulating the coins to be sorted, counted and packaged, since coins are almost universally circular.

Patents D and E, to Hall, provide for four tubes on a common base to act as a coin bank providing for all four common denominations of coins, the interior diameter being sized so that a coin wrapper may be inserted over the coins therein (although it is specified that the coin wrappers must first be cut diagonally at one end). These tubes are from an exterior aspect all of the same height but are provided with different interior base levels so that each is measured to accept the correct number of coins for a standard wrapper for that denomination. The principal difference between the two patents appears to be the provision in reference E of slots in opposite sides of the coin tubes so that an inserted wrapper may be gripped with the fingers.

The other cited patents each comprise a single tube, so that there must be a separate device for each coin denomination (also true of the present invention). Each also claims in one manner or another a means of measuring or metering the number of coins inserted therein.

Except for references B to Kelly and F to Vondra, each provides for inserting within the device a paper or standard coin wrapper. (1) Kelly provides a reusable clear tube, with a conical removable cap for closing the tube when the proper number of coins are inserted therein, and a push-button ejecting device on the bottomm for release of the coins. (2) In Vondra an element of novelty claimed is that the device has a removable bottom plug, so a tapered end may be partly inserted into a coin wrapper and coins poured from the device into the wrapper. The device is a tube with a measuring scale on the side and large funnel cap.

Reference A to Sherwood provides a hollow tube on a base with a pushrod supporting coins fed into the hollow tube.

Reference C to Lemieux is an open tube with a scoop shaped end into which coins are fed until a chamber of size determined by a stopper at the other end is filled by a proper number of coins. The device is then tilted, a wrapper inserted, and folding begun through a finger slot.

References G and H are both to Ventura, and present vertical tubes on a base with a pushrod inside the tube, and an external arm for metering number of coins. Provision is made for insertion of paper wrappers.

OBJECTS OF THE INVENTION

The objects of the invention are to provide an easily usable device which will stand on its base, allow coins to be fed through its funnel cap without counting them, into a paper wrapper inserted in its coin tube until it is full, then by rotating the cap, sweep off any coins in excess of the precise number desired, easily fold the wrapper at its ends, remove it, and repeat the operation.

Applicant believes his invention accomplishes these purposes easily, quickly and simply to a better result than any other device known to him.

SUMMARY OF THE INVENTION

The invention comprises a base, a coin tube with loading funnel cap pivotably mounted thereon, and a mandrel or tool for inserting the paper coin wrapper in the coin tube.

The parts of the overall assembly are designed to be manufactured by injection molding, preferably of polystyrene, or a similar material which possesses the desirable characteristics of low cost, moldability, and sufficient resistance to abrasion and wear to provide a useful service life. Polystyrene is transparent, so the device could be clear, however the invention contemplates tinting the material a different color for each denomination of coin. Clearly, a device of proper size is required for each coin denomination.

The functional parts of the device are the base, coin tube, funnel cap, mandrel shaft/work tip, and the collar which slides on the mandrel shaft. The pivot pin on which the funnel cap rotates can be cut from a rod or molded integrally with the top section of the coin tube. While a slight taper is required for the parts to be removable from an injection mold, they remain (generally) essentially cylindrical, and are so shown.

The base of the device is a flat support base of sufficient size to provide stability in use. As shown, it is circular, which is the simplest form for use and molding, but it need not necessarily be so. Projecting upward from the base, ideally in the center thereof, is a pedestal or coin support rod which, for ease of molding and cooperation with the coin tube is a right circular cylinder in configuration. The diameter of this coin support pedestal is such that it will easily fit inside the coin tube when the device is assembled for use (yet be large enough to support the specified coins), and its height is determined by the desired number of coins to be held in the coin tube, as explained below. Around the base of the pedestal is a partial tubular section, the top of which is shaped to provide a ramp or cam surface, with a vertical end face and flat support faces at different heights as described hereinafter. The outside diameter of this partial tubular section may, but need not necessarily, match that of the coin tube. The base, coin support pedestal and ramp section are intended to be molded in one piece.

The coin tube is a tube of circular cross-section sized in diameter to accept one of the standard U.S. coins, plus about 40 one-thousandths of an inch (0.040 inch, 1+ mm) for insertion of a paper coin wrapper. The bottom end of the coin tube provides a cam or ramp surface precisely matching that of the partial tubular section around the pedestal on the base, the purpose of which will be described below. The preferable form of cam to provide a transition between the flat end sections at different would be a helical ramp with a pitch of approximately one turn per inch, although this pitch need not be absolutely precise, as further detailed below. A sloping ramp or a step or plurality of steps would be feasible, but since a helical ramp provides smoother operation, the description of the best mode specifies a helical cam ramp, and the drawings show a curved ramp, not the alternative step or steps, which alternate, however, is considered to be within the disclosure herein. At the bottom of the interior portion of the coin tube, there is an annular restriction to provide support for the column of coins inserted therein. The length or height of the coin tube is also determined by the particular coin for which the device is sized, so that it will measure and hold (in conjunction with its pivoting funnel top and the coin support pedestal on the base) the correct number of coins to fill a standard paper wrapper for that denomination, as previously set forth herein.

The mandrel or inserting tool is used to open, insert and properly seat in the device's coin tube the paper wrapper to be filled with coins, which must be properly seated against the bottom restriction in the coin tube, as described below.

BRIEF DESCRIPTION OF THE DRAWINGS

FIG. 1(*a*) displays the base and coin support pedestal.

FIG. 1(*b*) shows one side view of the coin tube and coin loading funnel.

FIG. 1(*c*) shows the mandrel or wrapper inserting tool.

FIG. 2(*b*) is a side view of the mandrel tip.

FIG. 3(*b*) is a plan view of the loading funnel and its relation to the top of the coin tube, seen from above.

DESCRIPTION OF THE BEST MODE OF THE INVENTION

Figure 1C:
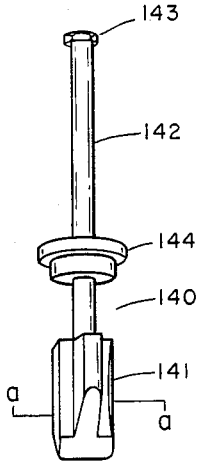
FIGS. 1(*a*), 1(*b*) and 1(*c*) show the coin packaging device in an exploded view.
Figure 1B:
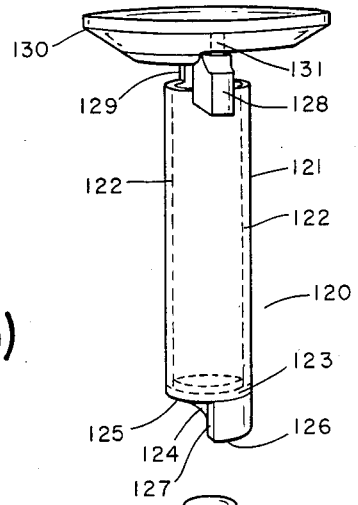
Figure 1A:
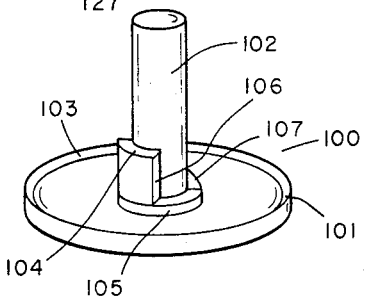

Referring first to FIG. 1(*a*), we see the base section denoted by 100, composed of a flat base 101, a coin support rod or pedestal 102, and in this view a raised edge 103, although this is not required. Around the bottom of coin support pedestal 102 is a partial cylindrical section comprising sections 104, 105,106 and 107. The upper surface of that portion of this partial cylindrical surface denoted at 107 (in this view mostly behind pedestal 102) is a helical surface which acts as a cam to raise and lower the coin tube with relation to the base (in cooperation with a similar surface 124 on the coin tube). This ramp or helical surface 107 circumscribes the coin support pedestal for about one-half of its circumference. There are two sections, marked 104 and 105 (each about one-quarter circumference), parallel to the base (perpendicular to the axis of the device) which are separated by vertical face 106. The outside diameter of this partial cylinder equals that of coin tube 120, to support said coin tube, although it need not match it exactly.

The coin tube 120 is shown in FIG. 1(*b*), with its funnel loading cap 130 in a closed position. The tube itself is numbered 121, the inner wall surface being shown as 122. The interior diameter of the tube (122) is just sufficiently larger than the standard diameter of the coin for which the device is sized to provide for insertion in the coin tube of a paper wrapper for that denomination of coin, so that the coins will snugly fill and fit in the wrapper. For example, the nominal diameter of a dime is 0.706 inch (17.9 mm), so the inner diameter 122 of coin tube 120 should be about 0.746 inch (18.95 mm). At 123, there is an annular restriction in the interior dimensions of the coin tube, both to position the paper wrapper and to act so that the inserted coins will be supported thereon when the coin tube is removed from or elevated above the base, removing the coins from the support by the pedestal 102. This inner restriction is located at a distance below the top of the coin tube extension 129 slightly greater than the length of the paper wrapper for the chosen denomination of coins. For dimes, this length is 3.45 inches (87.6 mm). The inner diameter of this restriction 123 is not critical, so long as it allows free passage for coin support pedestal 102, yet is sufficiently smaller than the diameter of the chosen coin to provide support for the column of coins.

The cam on the bottom of the coin tube, which cooperates precisely with the cam on the base, is shown with its helical ramp at 124, and again two sections of about one-quarter circumference each parallel to the base (or orthogonal to the tube axis) at 125 and 126, divided by vertical face 127. When the coin tube is fully bottomed and seated on the base, vertical faces 106 and 127 are pressed against each other and cam surfaces 104,105,107 and 125,126,124 are in contact (in that order) completely around support pedestal 102. If the base is held firm, and the coin tube rotated to the right into the page as shown (or counterclockwise viewed from above) through approximately one half turn the coin tube will be raised with respect to the base by the height of the helical cam surface and will be supported by surfaces 104 and 126 in contact. (The cam may of course be of opposite sense, so that a left hand rotation would lift the coin tube). The vertical lift by the cam should be one-half the length by which an empty paper coin wrapper exceeds the height of the column of coins to be loaded therein. This extra length for dimes is nominally 0.90 inch (22.86 mm) so the lift of the cam should be 0.45 inch (11.43 mm) for dimes, the lift varying slightly from coin to coin.

The funnel loading cap 130 is shown in its closed position, for loading coins into the coin tube 120 to which it is held in cooperative relationship by housing 128, containing pivot pin 131. Cap 130 is pivotably mounted to pivot pin 131 so that it is rotatable with respect to coin tube 120 and housing 128, through approximately one-half turn, as explained below. 129 indicates an extended part of the wall of coin tube 121, which acts in conjunction with cap 130 as described later below. The housing 128 provides a matching surface on the side opposite 129.

Figure 2B:
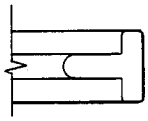
FIG. 2(*a*) is a cross-sectional view of the working tip of the mandrel, along section a—a in FIG. 1(*c*).
Figure 2A:
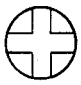

Referring to FIG. 1(*c*), we see the mandrel or inserting tool 140 which is used to open and insert the paper coin wrapper (not shown) in coin tube 120. The tip 141 of mandrel 140 is somewhat smaller in effective diameter than the coin for which the device is intended. Tip 141 is of cruciform cross-section, as shown in FIG. 2(*a*), to provide an essentially constant thickness of all elements for molding and curing. It is wedge shaped from one side, as seen in FIG. 2(*b*), for easier insertion into the paper wrapper. A sliding collar element 144 provides a pressure surface to seat the paper wrapper, being shaped in two short cylindrical sections, the smaller of which fits precisely inside the hole (335, see FIG. 3(*c*)) in the loading funnel cap, so that collar 144 will seat the paper coin wrapper fully in coin tube 120 (against restriction 123). Collar 144 may be assembled on shaft 142 by forcing it over cap 143.

Figure 3A:
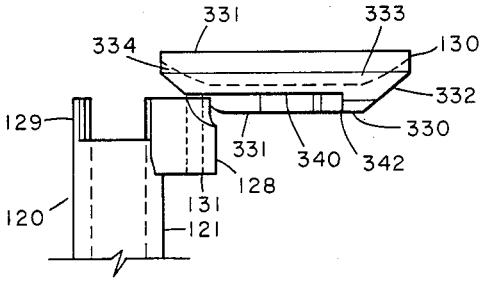
FIG. 3(*a*) is a side view (rotated slightly less than 90 degrees from FIG. 1(*b*)) of the top of the coin tube and the loading funnel (in open position).
Figure 3B:
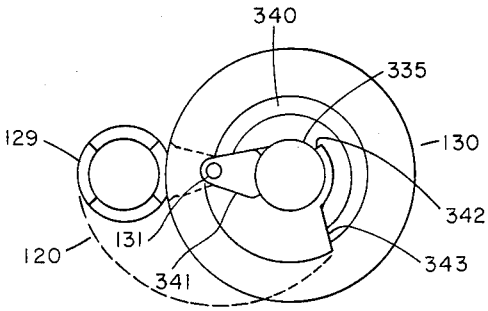

The configuration of the funnel cap 130 is explained with reference to FIGS. 3(*a*) and 3(*b*). FIG. 3(*a*) is a side view of the cap and the top of coin tube 120, with cap 130 in its fully open position, the coin tube 120 having been rotated 90 degrees to the right into the paper (or counterclockwise viewed from above) from the aspect in which it was seen in FIG. 1(*b*) and cap 130 then rotated 180 degrees in the same sense to its fully open position. Housing 128 acting against cap 130 prevents rotation of cap 130 in the opening direction beyond about one-half turn. Again, the rotation and sense of the funnel cap and its associated cams could be of the opposite sense so that it would open to the left rather than the right. It can be seen that the extended section 129 of the coin tube wall, which subtends an angle of only about 50 degrees at the center of the tube cylinder, is of precisely the same height as the top surface of housing 128, to which cap 130 is mounted by pivot pin 131.

The shape of the funnel cap 130 is frusto-conical, wider at the top, with bottom surface 330 and top edge 331 parallel. The outer conical surface 332 and the inner conical surface 333 may be parallel, but need not be, as convenient for molding. The cap may or may not have a vertical edge as shown at 334. The slope of inner conical surface 333 is as convenient to provide for easy loading of coins into opening 335 (FIG. 3(*b*)), through which they enter coin tube 120. This angle is about 70–75 degrees relative to the axis of the coin tube/funnel cap assembly.

The bottom surface of cap 130 is relieved or raised as shown in FIG. 3(*a*) to provide a planar surface above and parallel to the nominal bottom plane 330. This surface, denoted at 340, is bounded by edges between its level and that of 330 indicated at 341,342 and 343, which edges act as a cam to accurately register cap 130 with coin tube 120 when the cap is in its closed position. (In FIG. 3(*b*), which is a top view of funnel cap 130 in its relationship to tube 120, can edges 341,342, and 343 are shown in solid lines to make them more clear, although they are on the bottom surface of cap 130. Since the material is transparent, they can be clearly seen.) As indicated in FIG. 3(*a*), mounting housing 128 will register against raised bottom surface 340 when cap 130 is in its closed position with edge 341 (FIG. 3(*b*)) abutting against the side of mounting housing 128.

Edge 343 (FIG. 3(*b*)) acts as a cam against the outer surface of tube portion 129, to position and lock funnel cap 130 into its closed position. The curved section of 343 subtends an arc substantially equalling that of section 129 of the coin tube, and there is a slight boss or protruberance inwards of edge 343 where the curved and straight portions meet. When cap 130 is closed, the straight portion of 343 passes outside while the curved portion slides around and encompasses 129. The curvature of edge 343 precisely matches that of 129 (which must distort slightly to allow passage of the boss) to assure that cap 130 is accurately aligned with coin tube 120. When the cap is closed, edge 342 acts as a stop against one edge of tube portion 129, and the boss on 343 acts on the other edge to lock cap 130 into place.

To operate the device to stack and then wrap coins, the invention is assembled with the coin tube 120 lowered onto base 100, and funnel cap 130 in closed position. Mandrel 140 is inserted into an empty paper coin wrapper, and then used to insert the wrapper in coin tube 120, pushing the wrapper down with collar 144 until it rests on restriction 123 at the bottom of tube 120. As said before, the smaller portion of collar 144 fits inside loading hole 335 to facilitate seating the wrapper. The mandrel is then removed.

Coins are then loaded into tube 120 by pouring or placing them in funnel 130, the angle of which facilitates coin entry in a flat aspect through loading hole 335 into the coin tube, the first coin coming to rest on the top of pedestal 102, which projects into coin tube 120 a distance which is determined to leave precisely sufficient space between the top of pedestal 102 and surface 340 on the funnel cap (which is the same distance as to the top edge of tube extension 129) to allow stacking of the proper number of coins for the denomination selected. (For dimes, for example, this distance should be 2.55 inches (64.77 mm) for 50 coins, plus a clearance of about one-half coin to assure clearing the 50th coin while sweeping off the 51st.) Succeeding coins form a column within coin tube 120 until the wrapper is full. At that time, loading funnel cap 130 is turned (counterclockwise from above), sweeping off any excess coins over and above the proper number, which can be caught as they fall through loading hole 335 after it clears coin tube 120.

When loading is complete and the excess coins have been removed, coin tube 120 is rotated slightly over a half turn, which raises it by cam 107 and 124, to the point where surface 126 rests on 104, holding the coin tube above the base. The coins inside the tube will now drop until they rest on restriction 123. At this time, the top of the paper wrapper is pinched together through the open sides at the top of tube 120, (between extension 129 and pivot housing 128). The coin tube is inverted, the column of coins in their paper wrapper removed and the other end of the wrapper pinched to retain the coins in their package. The operation may then be repeated as necessary.

I have described my invention in its preferred form, but the disclosure is not limited to that precise form and is intended to include the various modifications and alternatives which should be readily apparent to one skilled in the art.

I claim as my invention:

1. A reusable device for counting, and wrapping or storing coins, comprising:

a. a base disposing upwardly therefrom a generally cylindrical coin support pedestal, wherein around the base of said coin support pedestal is a partial cylinder adapted as a cam surface, the upper edge of said partial cylinder providing over part of its circumference surrounding said coin support pedestal a ramp, said ramp being bounded at its ends by two flat sections parallel to the plane of said base, one of said flat sections being in the plane of the surface of said base, the other said flat section being substantially higher, said flat sections being separated by a vertical edge of the said partial cylinder, b. a coin tube which may be removably emplaced upon said base, wherein the lower end of said coin tube disposes a cam surface in cooperative relationship with the said cam surface surrounding said coin support pedestal, so that when said coin tube is fully lowered onto said base with said coin support pedestal projecting interiorly within said coin tube, said coin tube is supported completely by the partial cylinder surrounding said coin support pedestal, and if said coin tube is rotated approximately one half turn relative to said base, said coin tube is raised by the cooperative interaction of said cam surface disposed on the lower end of said coin tube with said cam surface disposed as a partial cylinder on said coin support pedestal a distance which is substantially half the height by which an empty paper coin wrapper adapted to hold the specified plurality of coins which the device is intended to package exceeds the height of said stacked specified plurality of coins sufficient to fill said coin wrapper, said coin tube being there supported by the said bounding flat sections, providing that the interior diameter and length of said coin tube cylinder is adapted to accept substantially closely a paper wrapper to hold a specified number of a specified denomination of coin, said paper wrapper being supported by an annular restriction at the lower end of said coin tube, said restriction being located at a distance below the top of said coin tube slightly greater than the length of said specified paper wrapper, said annular restriction being further adapted to support said coins in said wrapper in said coin tube when said coin tube is raised or removed from said base, again providing, that said coin support pedestal project into said coin tube, through said annular restriction, just so far that the effective height above it to the top of said coin tube and said paper wrapper will precisely accept the proper number of coins for said standard paper wrapper, further providing that openings in the upper end of said coin tube are provided so that after said paper wrapper is loaded and said coin tube raised by means of the action of said cooperating cam surfaces on said coin tube and said coin support pedestal, the upper end of said paper wrapper may be pinched closed, and said coin tube removed and inverted for removal and closure of said coins in said paper wrapper;

c. a substantially funnel shaped loading cap, disposing an upper opening of substantially greater diameter than its lower opening which said lower opening closely cooperates with the upper opening of said coin tube, wherein said loading cap is pivotably mounted in close cooperation with the top of said loading tube, and disposes on its lower surface an edge formed between two portions of the lower surface of said loading cap, said edge being curved so that as said cap is closed over said coin tube, said edge acts a cam against the outer surface of said coin tube to assure positive closure and precise alignment of said lower opening of said cap with said coin tube, providing the inner slot of said loading cap is adapted to guide coins placed therein into said coin tube when said loading cap is in its closed position, again providing that when said coin tube is full, rotation of said loading cap to its open position will remove any coins in excess of the number required to fill said standard paper wrapper, d. in combination with said coin tube and loading cap, a mandrel comprising a shaft disposing a wedge shaped tip for opening a paper coin wrapper and inserting it in said coin tube, there being disposed in sliding relationship over the shaft of said mandrel an associated collar said sliding collar being configured as two cylindrical sections of differing diameters, that section of smaller diameter being so adapted as to fit inside said coin tube and bear against said paper wrapper to fully seat it within said coin tube.

2. A device as in claim 1 adapted to count and wrap 50 United States dimes.

3. A device as in claim 1 adapted to count and wrap 40 United States nickels.

4. A device as in claim 1 adapted to count and wrap 50 United States pennies.

5. A device as in claim 1 adapted to count and wrap 40 United States quarters.

6. A device as in claim 1 adapted to count and wrap any specified number of a specified size of coin or medal.

* * * * *

UNITED STATES PATENT AND TRADEMARK OFFICE

CERTIFICATE OF CORRECTION

PATENT NO. : 4,722,714

DATED : February 2, 1988

INVENTOR(S) : Edgar F. Marbourg, Jr.

It is certified that error appears in the above-identified patent and that said Letters Patent is hereby corrected as shown below:

The title page should be deleted to appear as per attached title page.

Signed and Sealed this

First Day of November, 1988

*Attest:*

*Attesting Officer*

DONALD J. QUIGG

*Commissioner of Patents and Trademarks*

United States Patent [19]

Marbourg, Jr.

[11] Patent Number: 4,722,714

[45] Date of Patent: Feb. 2, 1988

[54] COIN PACKAGING DEVICE

[76] Inventor: Edgar F. Marbourg, Jr., 437 Hillcrest Rd., San Carlos, Calif. 94070

[21] Appl. No.: 892,328

[22] Filed: Aug. 4, 1986

[51] Int. Cl.[4] ..... G07D 9/06

[52] U.S. Cl. ..... 453/59; 53/254; 453/62

[58] Field of Search ..... 133/1 R, 1 A, 8 R, 8 A; 53/212, 213, 254; 453/59, 62

[56] References Cited

U.S. PATENT DOCUMENTS

| | | | |
|---|---|---|---|
| 961,832 | 6/1910 | Ayres | 133/1 A X |
| 1,274,615 | 8/1918 | Sherwood | 133/1 A X |
| 3,967,435 | 7/1976 | Bergmaier | 53/254 |
| 4,036,358 | 7/1977 | Kelley | 133/1 A X |
| 4,091,599 | 5/1978 | Lemieux | 133/1 A X |
| 4,153,197 | 5/1979 | Hall | 232/5 |
| 4,244,157 | 1/1981 | Vondra et al. | 133/1 A X |
| 4,407,313 | 10/1983 | Ventura | 133/8 A |
| 4,407,314 | 10/1983 | Ventura | 133/8 A |

*Primary Examiner*—F. J. Bartuska
*Attorney, Agent, or Firm*—Marshall C. Gregory

[57] ABSTRACT

A coin counting and packaging device in which a coin counting tube is precisely dimensioned so that a specified standard paper coin wrapper will just fit inside and accept the proper number of coins to fill the wrapper, the coins being fed through a loading cap which acts to sweep away any extra coins over and above the proper number, thus determining the correct count. While the coins are being loaded and counted they rest on a support pedestal projecting up into the coin tube from a base; when the tube is full, and raised off the base, the coins rest on a rim at the bottom of the tube. The coin tube has on its bottom edge a cam surface which cooperates with a mating cam on the support base, to raise the coin tube a distance such that the upper end of the paper wrapper may be pinched shut at the top of the tube, preparatory to removing the coin-filled wrapper.

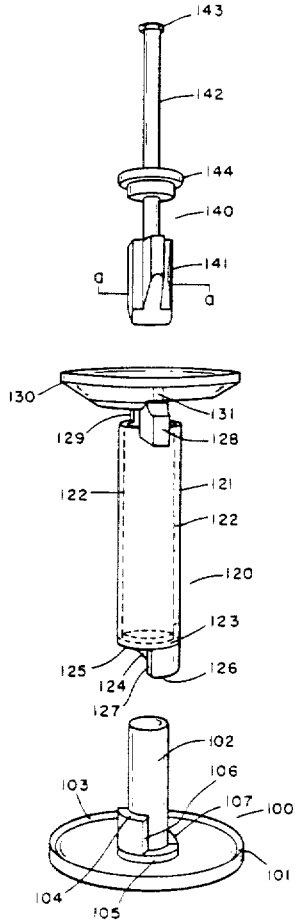

6 Claims, 7 Drawing Figures